United States Patent [19]

Luck

[11] Patent Number: 4,543,858

[45] Date of Patent: Oct. 1, 1985

[54] HANDLE FOR STRAP WRENCHES AND OTHER TOOLS

[76] Inventor: Stephen K. Luck, 9249 Lemon Ave., La Mesa, Calif. 92041

[21] Appl. No.: 224,554

[22] PCT Filed: Mar. 13, 1980

[86] PCT No.: PCT/GB80/00044

§ 371 Date: Nov. 14, 1980

§ 102(e) Date: Nov. 14, 1980

[87] PCT Pub. No.: WO80/01887

PCT Pub. Date: Sep. 18, 1980

[30] Foreign Application Priority Data

Mar. 14, 1979 [GB] United Kingdom ..... 7909068
Apr. 3, 1979 [GB] United Kingdom ..... 7911519

[51] Int. Cl.[4] ..... B25B 13/52
[52] U.S. Cl. ..... 81/64; 81/3.43
[58] Field of Search ..... 81/64, 3.43; 16/114 R, 16/114 A, 114 B

[56] References Cited

U.S. PATENT DOCUMENTS

| | | | |
|---|---|---|---|
| 409,148 | 8/1889 | Haller | 81/3.43 |
| 2,319,147 | 5/1943 | Mason | 16/114 B |
| 2,398,436 | 4/1946 | Mason | 16/114 B |
| 4,007,650 | 2/1977 | Wellman | 81/64 |
| 4,082,016 | 4/1978 | Vonusa | 81/3.43 |

FOREIGN PATENT DOCUMENTS

| | | |
|---|---|---|
| 388572 | 3/1933 | United Kingdom . |
| 745937 | 3/1956 | United Kingdom . |
| 1391409 | 4/1975 | United Kingdom . |
| 1456878 | 12/1976 | United Kingdom . |

*Primary Examiner*—James L. Jones, Jr.
*Attorney, Agent, or Firm*—Charles E. Brown

[57] ABSTRACT

A handle for a strap wrench or other tool is assembled from two components (1,2), which components are provided with cooperating elements whereby the two components may be releasably joined together. Preferably, each component is provided with at least one projection (4) adapted to be received within a recess (5) in the other component. A strap wrench comprises such a handle together with a strap (3), one end of the strap being attached, e.g. by a pin (15), to one component (1), the second component (2) of the handle being associated with the strap (3) by means of a guide member (18) through which the strap may pass, thereby permitting variation in the size of the loop (16) formed by the strap for engagement with a workpiece. The means for releasably joining together the components of the handle permit the use of the strap wrench on objects, such as a length of pipe, having inaccessible ends.

15 Claims, 2 Drawing Figures

HANDLE FOR STRAP WRENCHES AND OTHER TOOLS

FIELD OF THE INVENTION

The present invention relates to a handle suitable for strap wrenches and other tools. It also relates to a strap wrench incorporating such a handle.

BACKGROUND TO THE INVENTION

A strap wrench is a tool comprising a flexible strap so attached to a handle that the strap may form a loop. In use, the strap is looped around an object to which torque is to be applied and brought into frictional engagement therewith; the handle is then operated as a lever in order to apply the torque.

Usually, one end of the strap is permanently fastened to the handle whereas the other end can be passed freely through a guide member in order to permit the size of the loop to be continuously adjustable within limits. Prior to use, the loop is closed around the object by taking up the slack by means of the free end of the strap. The handle usually is provided with a working surface adapted to abut a part of the outer surface of the loop. Thus, the strap is gripped, in use, between the said working surface and the object, thereby preventing any loosening of the strap loop.

Small wrenches of this type have been marketed as household gadgets for enabling screw-threaded tops, caps and lids to be readily removed from such containers as bottles and jars. Heavy-duty wrenches of this type are also known; these may utilise a roller chain as the flexible strap (see, for example, U.K. Patent Specification No. 1,222,671).

In the Complete Specification of U.K. Pat. No. 1,347,325 to W. Rutz, there is disclosed a strap wrench wherein the two ends of the strap (which may be a flexible metal strip) extend into the handle. At least one end of the strap is secured to a slide shoe which is mounted on a spindle that is axially immovable, but which can be rotated by means of a grip located on the outside of the handle.

The spindle and slide shoe have complementary screw threads; accordingly, on rotating the spindle by means of the grip, the slide shoe will be moved along the spindle in a desired direction, thereby increasing or decreasing the length of the strap in the loop extending beyond the handle. In this device, the strap is not gripped between the object and a working surface on the handle. Instead, the loop is tightened by rotation of the grip to the desired extent; the slide shoe will then remain fixed, thereby preventing the loop from loosening, until the grip is rotated in the opposite sense.

One disadvantage of the prior-art strap wrenches, however, is that they are difficult or awkward to use on an object whose ends are inaccessible, or accessible only with difficulty, for example, a connector in a long length of piping or conduit. It is usually necessary to remove the free end of the strap from the guide member in the handle and then pass it around the object to be gripped and then back through the said guide member. This is, at best, a cumbersome operation, and may prove extremely difficult for handicapped operators. Moreover, in strap wrenches of the type disclosed by W. Rutz (above), this operation cannot be carried out at all, since both ends of the strap are secured within the handle.

In U.K. Patent Specification No. 388,572 there is disclosed a gripping wrench having two separable members having handle-like portions, which members are secured together by a detachable screw. The wrench is provided with jaws. However, for use with a pipe that is too large to fit within the jaws, a chain is mounted by means of a pin on one of the members, which chain is then passed around the pipe and secured to a hook on the other member. Tension is applied by squeezing together the handle-like portions and is maintained by placing a peg in one of a series of holes in one member; the peg then acts as a stop for the other member. Again, this procedure is rather awkward.

SUMMARY OF THE INVENTION

The present invention provides a handle for a strap wrench or other tool, which handle is assembled from a first component and a second component and has means for releasably joining together the said first and second components. In general, the joining means comprises at least one element provided on one component, which element is adapted to engage an element provided on the other component. Advantageously, the said elements are formed as integral parts of the said components.

Preferably, the joining means comprise a projection on at least one of the components, which projection is adapted to engage in a complementary recess in the other component. It is especially preferred that each of the first and second components be provided with at least one projection that is adapted to engage in a complementary recess in the other component.

Preferably, each component has a slide surface adapted to slide against an opposing surface of the other component such that the or each projection is moved into its respective recess.

The handle of this invention may, for example, be used in knives with removable or reversible blades. The handle could also be used in lifting devices, e.g. for baggage and the like. However, it is particularly useful in strap wrenches.

Accordingly, the present invention also provides a strap wrench comprising a handle according to the present invention and an elongate flexible member (hereinafter also referred to simply as a "strap") so attached to the handle that the flexible member may form a loop.

In the strap wrench of this invention, the first component of the handle preferably has means for securing the strap at one end of the loop; the second component of the handle preferably has means for associating that component with the strap at the other end of the loop.

Thus, in order to employ this strap wrench with an object whose ends are inaccessible, or accessible only with difficulty, the operator merely needs to release the first component of the handle from the second component, pass one component around the object, which will take the secured or associated end of the strap with it and to re-assemble the handle from the first and second components, leaving the strap looped around said object. After using the strap wrench to apply the required torque, the aforesaid steps may, if required, be followed in the reverse sequence in order to free the strap wrench from the object.

It is conceivable that the means for associating the said second component with the strap could be a securing means. However, it is preferred that the said second component be associated with the strap by means of one or more guide members located within or on the said second component, which guide members permit movement of the strap relative to the handle in order to adjust the size of the loop.

It is also preferred that both ends of the loop should pass into the same aperture in the assembled handle. This arrangement enables the strap wrench to be used on objects having a comparatively small diameter.

In fact, another advantage of the present invention is that a strap wrench can be provided that is adjustable over a large range of diameters of objects to be gripped.

DESCRIPTION OF THE PREFERRED EMBODIMENTS

Figure 1:
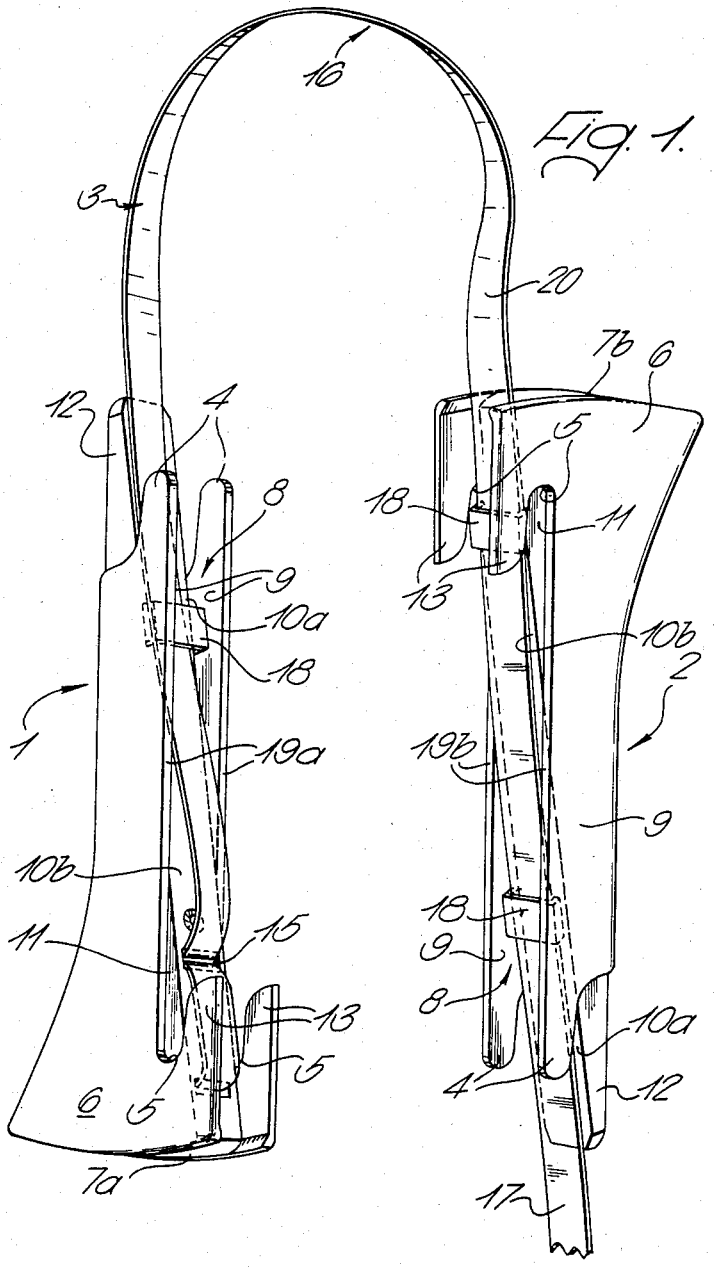
FIG. 1 is a perspective view of an exemplary strap wrench according to the present invention, with the components of the handle in an unassembled state.

The strap wrench according to the present invention that is illustrated in FIG. 1 comprises a handle formed by two components 1 and 2. These components 1 and 2 are preferably moulded from a plastics material, such as an ABS polymer or polypropylene. However, in particular for heavy-duty use, the components 1 and 2 may be made of metal, for example die cast aluminium or an alloy thereof.

The strap wrench also comprises a flexible strap 3, which may be formed of any material having the desired flexibility, strength and grip. Rubber has proved a suitable material, especially when reinforced with fibres of a polyester, for example "Dacron" (trade mark). However, it is also possible to employ a thin metal strip (although this may tend to develop unwanted "kinks" therein) or even a roller chain, especially when the wrench is intended for heavy-duty uses; the term "strap" is to be construed accordingly.

Figure 2:
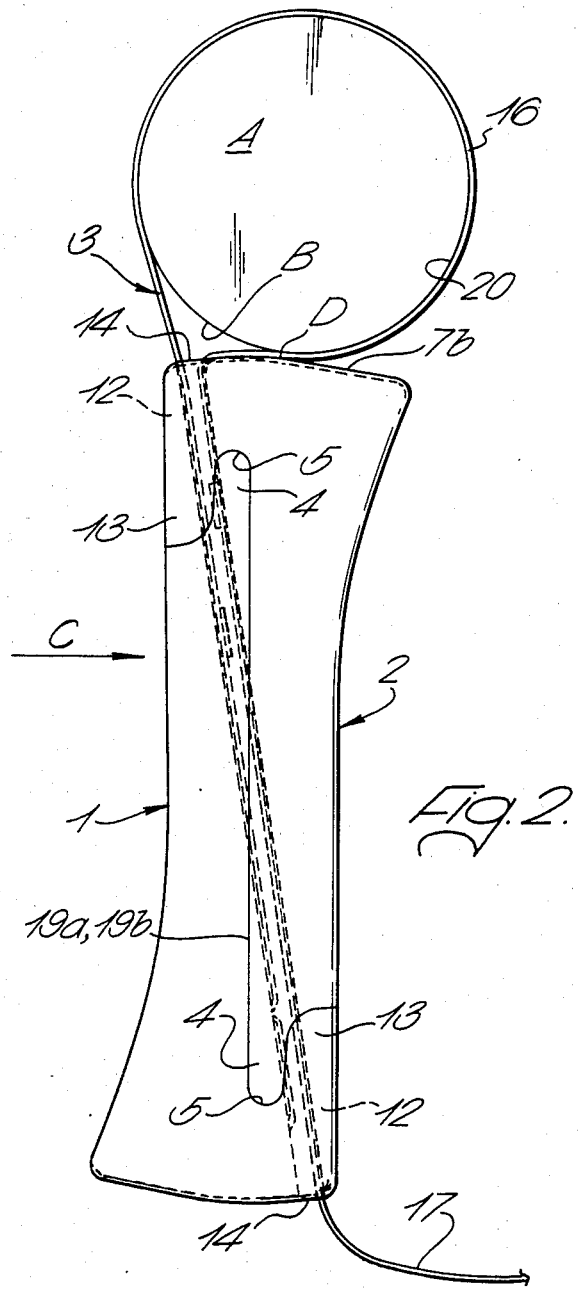
FIG. 2 is a top view of the strap wrench shown in FIG. 1, but with the handle assembled and with the strap looped about a jar lid in readiness for use.

Each of the components 1 and 2 has, at one end thereof, two projections 4, each projection 4 being adapted for reception within a complementary recess 5 formed within the other component. The manner in which the projections 4 fit into the recesses 5 in the assembled handle can be seen clearly in FIG. 2. As indicated in FIG. 2, it can be of advantage for the projections 4 to extend in a direction that is substantially parallel to the "long" dimension of the assembled handle. Since, in use, the handle will normally be subjected to a force acting at a right angle to the long axis, the illustrated disposition of the projections will guard against inadvertent disassembly of the handle during use.

Each component 1 or 2 is formed with an enlarged head 6, providing a surface 7*a* or 7*b* which is generally perpendicular to the long axis of the assembled handle. In fact, in the illustrated embodiment, each surface 7 has a slight, cylindrically convex shape; however, it would, in principle, be possible to have surfaces 7 that are either planar or slightly, cylindrically concave. Moreover, the surface 7*b* may be provided with means for increasing the friction, e.g. ribs or ridges.

Each component 1 and 2 is formed with a channel 8 between the sidewalls 9, the depth of which channel diminishes towards the head 6. The rear wall 10*a* of the channel is contiguous with a surface 10*b* defined by a ramp-like member 11, which is located between, but stands proud of, the sidewalls 9 near the head 6. (Hereinafter, when the rear wall 10*a* and the ramp surface 10*b* are regarded as a single, continuous surface, they will be designated as 10.)

At the end remote from the head 6, the channel floor 10*a* runs along a tongue 12. In the assembled handle, each tongue 12 partially seals the gap between the two re-entrant portions 13 of the sidewalls 9 of the complementary component 1 or 2.

In the assembled handle, the sidewalls 9 and the surfaces 10 define a conduit extending right through the assembled handle 1,2 between apertures 14 (see FIG. 2), each aperture being defined in part by the surface 7 and the tip of an adjacent tongue 12.

One end of the strap 3 is fastened by a pin 15 in a slot in the ramp-like member 11 near the head 6 of component 1. It will be appreciated that the pin 15 is merely one of a variety of means that can be employed to secure the end of the strap 3; for example, the said end of the strap could be fixed by means of a metal mushroom end or even with the use of a sufficiently powerful adhesive.

The strap 3 extends from its secured end along the surface 10 of component 1, into a loop 16 beyond the handle and then back along surface 10 of the component part 2 of the handle. As shown in FIG. 2, the free end 17 of the strap 3 emerges from the aperture 14 at the end of the handle that is remote from the loop 16.

On each surface 10*a* and 10*b* of component 2, there is provided a bridge 18, each bridge 18 defining, with its respective surface 10*a* or 10*b*, a rectangular aperture through which the strap 3 passes. Thus, the bridges 18 serve as guide members for the strap. A similar bridge 18 is provided on surface 10*a* of component 1.

It will be noted that, apart from the extra bridge 18 on component 2 and the fastening pin 15, component parts 1 and 2 of the handle are substantially identical. In fact, if the fastening pin were to be attached to the end of the strap, each of the component parts 1 and 2 could be provided with a detent for the pin; with identical components 1 and 2, the production apparatus requirement would be reduced by half. Moreover, the ordering of a replacement part, should one part of the handle be damaged, would be simplified. Even as illustrated, the similarity in configuration of components 1 and 2 makes production tooling simpler; moreover, the "symmetrical" design of the handle has aesthetic appeal.

Each sidewall 9 defines a straight, flat surface 19*a* or 19*b*, each such surface extending longitudinally between a recess 5 and a projection 4. In the assembled handle each surface 19*a* of component 1 contacts a corresponding surface 19*b* of the component 2.

To assemble the handle, the components 1 and 2 are brought together such that surfaces 19*a* engage in parallel relationship with surfaces 19*b*, each projection 4 pointing towards a complementary recess 5. On sliding the components 1,2 together, each projection 4 is received within a recess 5 and each ramp-like member 11 is received within the channel 8 of the opposing component, as indicated in FIG. 2, which illustrates the fully assembled handle.

The principle of operation of the strap wrench is illustrated in FIG. 2, which shows how the wrench can be used to remove a lid "A" from a jar (not shown). As indicated in that Figure, the handle is assembled and the loop 16 of the strap 3 is positioned so that it encircles the rim B of the lid A. The loop 16 has been brought into close engagement with the rim B by taking up the slack by pulling the free end 17 away from the aperture 14 remote from the loop 16.

The surface 20 of the strap 3 which is adapted to engage the object to be turned (here a jar lid A) is preferably flat, in order to maximise the area of contact between the strap and the object. However, it may be mentioned at this point that it is possible to provide the surface 20 with ridges or some other surface configuration.

It will be seen that part of the strap 3 is abutted by a surface *7b* (which is regarded as the "working surface"). On applying a force in the direction indicated by the arrow C, the working surface *7b* will urge part of the strap 3 against the rim B (in the region marked D), thereby gripping it. This gripping of the strap 3 between the working surface *7b* and the rim B prevents the loop 16 from loosening during the application of the force in the direction C. Thus, it is not essential to provide anchoring means for the free end 17 of the strap 3 (although it would be possible to do so).

Owing to the frictional engagement of the strap 3 with the rim B, the force applied in the direction C results in a torque being applied to the lid A tending to rotate said lid in the counter-clockwise direction (as viewed in FIG. 2).

The turning action described above also tends to urge the components 1 and 2 together (i.e. projections 4 are urged more tightly into recesses 5), which reduces the risk of inadvertent disassembly during use.

To demonstrate the advantage of the strap wrench according to the present invention, one may visualise A in FIG. 2 as being a cross-section through a pipe or conduit having ends that are inaccessible. It will be seen that with a handle having a unitary, rather than two-piece, construction the operative position shown in FIG. 2 could be reached only by pulling the free end 17 of the strap up through the central conduit and then passing the free end 17 around the pipe A. It would then be necessary to pass the end 17 back through the central conduit in the handle, which would be a difficult enough procedure even without the bridges 18.

However, the construction according to the present invention solves the problem in a surprisingly neat and simple manner. The operator merely needs to disassemble the handle and pass the component part 1, to which one end of the strap 3 is attached (thereby forming the loop 16) around the object to be turned. During this operation, the bridges 18 on component part 2 keep the strap 3 associated with that part of the handle. Once the loop 16 has been formed around the object to which torque is to be applied, the operator merely reassembles the handle in situ.

Of course, the embodiment illustrated in FIGS. 1 and 2 may be subjected to various modifications. Thus, variations in the material of construction of the handle and of the flexible strap have already been indicated, as has the possible provision of an anchoring device for the free end 17 of the strap. Variations in the configuration of the working surface 7 have also been mentioned, as have different methods for securing an end of the flexible strap 3 to the component 1.

In the illustrated embodiment, the components 1 and 2 are held together by frictional forces. Thus, each projection 4 may be frictionally engaged within its recess 5. Moreover, there may be friction between the sides of the ramp-like members 11 and the inner faces of the sidewalls 9.

Alternatively, it would be possible to provide the projections 4 and recesses 5 with detents (e.g. surface "pips" which fit into small depressions). Again, it would be possible to form each projection with a slightly enlarged end which can be forced past a reduced or "necked" portion of the recess: this is suitable when the handle components are made of a resilient material.

In the illustrated embodiment, the ends of the tongues 12 are fairly slender. It would be possible to provide ribs or other structures adapted to impart greater strength to the tongues 12, especially if heavy-duty use is envisaged.

Furthermore, it is not absolutely essential to provide the bridge 18 on the component 1; however, it is considered that the bridge 18 serves a useful purpose by preventing undue "flopping" of the strap upon disassembly.

It is also possible to employ guide means on the component part 2 other than the bridge members 18. For example, it would be possible to form a separate conduit extending through the body of component 2, which conduit would serve as a guide member for the strap. Component 1 could also be provided with such a conduit, and could, with advantage, be formed with an identical configuration to component 2.

The two conduits would preferably be arranged to terminate at each end of the assembled handle in the same aperture.

In the illustrated embodiment, the handle has two components, each component having a male end and a female end. However, other dispositions of the projections and recesses are possible. Similarly, the central conduit need not have the diagonal disposition illustrated.

The dimensions of the handle may be varied, depending upon such factors as the desired leverage, ease of grip, extent of the working surface, weight and balance.

The use of the present strap wrench in the household and for the turning of pipes and connectors therein has been alluded to. The wrench has, of course, other uses in engineering, for example in the removal or fitting of engine oil filters. A present wrench could even be employed in first aid, for example as a tourniquet; the strap would then preferably be padded and a locking device would preferably be incorporated to hold the free end of the strap, in order to leave the medical attendant's hands free for other purposes.

I claim:

1. A strap wrench of the type including a handle and an elongate flexible member attached to said handle with said flexible member forming a loop; the improvement wherein said handle comprises separably formed first and second components, each component having joining means for releasably joining together said first and second components to form said assembled handle, said joining means including a projection provided on at least one of said components, and the other of said components being provided with a complementary recess within which said projection is received during assembly of said handle.

2. A strap wrench according to claim 1, characterized in that each of said first and second components has at least one projection receivable in a complementary recess in the other component.

3. A strap wrench according to claim 1 or 2, characterized in that each projection extends in a direction generally parallel to the long axis of the assembled handle.

4. A strap wrench according to claim 1 or 2, characterized in that each projection has frictional engagement within its complementary recess.

5. A strap wrench according to claim 1, characterized in that each of said projections and recesses is an integral part of its respective component.

6. A strap wrench according to claim 1, characterized in that each of said first and second components has an enlarged head portion at one end, said head portion having at least one of said complementary recesses formed therein, said one recess opening towards the end of the respective component remote from the head portion, said remote end being provided with at least one projection extending away from the head portion.

7. A strap wrench according to claim 1, characterized in that each of said components has at least one surface movable into sliding contact with a corresponding surface on the other of said components such that each projection is received within its complementary recess upon sliding of said first and second components together.

8. A strap wrench according to claims 1 or 7, characterized in that each of said components has two sidewalls each defining a flat surface on its top edge, said sidewalls being separated by an inclined surface inclined to the plane of said flat surfaces and defining a ramp-like member forming a projection beyond said flat surfaces near one end of the respective one of said components, said inclined surface with said sidewalls defining a channel near the other end of the respective component, said flat surfaces on one of said components being in engageable sliding contact with said flat surfaces of the other of said components, said ramp-like member on one of said components being received within said channel in the other of said components.

9. A strap wrench according to claim 1 or 7, characterized in that each of said components has two sidewalls each defining a flat surface on a top edge, said top edge extending at one end into a recess and at the other end along a projection, said flat surfaces on one of said components being movable into sliding contact with the surfaces of the other of said components with each of said projections being received within a corresponding one of said recesses.

10. A strap wrench according to claim 1, characterized in that the said first component of said handle is provided with means for securing said flexible member at one end of the loop.

11. A strap wrench according to claim 10, characterized in that the said second component of said handle is provided with guide means cooperable with said flexible member at the other end of said loop, said guide means facilitating movement of said flexible member for the purpose of adjusting the size of said loop.

12. A strap wrench according to claim 11, characterized in that there is conduit in said assembled handle for said flexible member, said conduit being defined by parts of said first and second components of said handle, said guide means including at least one bridge member for holding part of said flexible member adjacent to said second component of said handle.

13. A strap wrench according to claim 12 wherein each of said components has two sidewalls separated by an inclined surface, and said conduit is defined by said sidewalls and said inclined surfaces.

14. A strap wrench according to claim 1, characterized in that said handle includes a working surface for abutting a part of the surface of said loop.

15. A strap wrench according to claim 1, characterized in that said first and second components have substantially identical configurations.

* * * * *